US005361944A

United States Patent [19]

Hauf et al.

[11] Patent Number: 5,361,944

[45] Date of Patent: Nov. 8, 1994

[54] DEVICE FOR THE CONDITIONING AND THE DISTRIBUTION OF PASTY OR LIQUID PRODUCTS

[75] Inventors: Eric Hauf, Lausanne; Jaime Rossell, Pully; Michel Gueissaz, L'Auberson, all of Switzerland

[73] Assignees: AKA Innovative Developments S.A., Ecublens; Andre Gueissaz & Cie S. A., L'Auberson, both of Switzerland

[21] Appl. No.: 920,684

[22] Filed: Jul. 28, 1992

[30] Foreign Application Priority Data

Jul. 29, 1991 [CH] Switzerland ..... 02259/91-0
Jun. 16, 1992 [CH] Switzerland ..... 01894/92-5

[51] Int. Cl.[5] ..... B67D 5/52

[52] U.S. Cl. ..... 222/136; 222/254; 222/256; 222/341; 222/383

[58] Field of Search ..... 222/135–137, 222/336, 339, 340, 341, 254, 255, 256, 383, 387

[56] References Cited

U.S. PATENT DOCUMENTS

| | | | |
|---|---|---|---|
| 1,164,754 | 12/1915 | Rose | 222/341 |
| 2,233,716 | 3/1941 | Seidel | 222/341 X |
| 2,283,529 | 5/1942 | Bobrick | 222/341 X |
| 2,529,365 | 11/1950 | Barksdale | 222/341 X |
| 2,622,539 | 12/1952 | Martin | 222/341 X |
| 2,703,191 | 3/1955 | Jernander | 222/341 X |
| 2,824,673 | 2/1958 | Hanlon | 222/340 X |
| 3,760,986 | 9/1973 | Castner et al. | 222/137 |
| 4,438,871 | 3/1984 | Eckert | 222/256 X |
| 4,485,943 | 12/1984 | Czech | 222/340 X |
| 4,502,617 | 3/1985 | Stecker et al. | 222/341 X |
| 4,687,663 | 8/1987 | Schaeffer | 222/137 X |
| 4,823,818 | 4/1989 | DeBuyer | 222/255 X |
| 4,872,596 | 10/1989 | Corsette | 222/256 X |
| 4,949,874 | 8/1990 | Fiedler et al. | 222/256 X |

FOREIGN PATENT DOCUMENTS

| | | |
|---|---|---|
| 0282595 | 9/1988 | European Pat. Off. . |
| 2634825 | 2/1990 | France . |
| 2641337 | 7/1990 | France . |
| 2647757 | 12/1990 | France . |

*Primary Examiner*—Kevin P. Shaver
*Attorney, Agent, or Firm*—Young & Thompson

[57] ABSTRACT

A device for the conditioning and the distribution of pasty or liquid products comprises a casing 1 in which is located a primary chamber 3 divided in two parts by a free piston 4. This primary chamber 3 communicates with a secondary chamber 7 thanks to an aspiration channel in which is located a non-return valve 9. The secondary chamber 7 comprises a piston 16 freely sliding in this chamber and tightly connected to a push button 17 which comes out of the casing. The secondary chamber communicates by an expulsion channel having a non-return valve 12 with an expulsion hole 2 of the product. Under the action of the control piston 16, the product dose contained in the secondary chamber is expelled. When the piston 16 comes back in position a new amount of product passes from the primary chamber 3 toward the secondary chamber 7, and the non-return valve 12 prevents any intake of air inside the casing.

7 Claims, 6 Drawing Sheets

FIG. 1
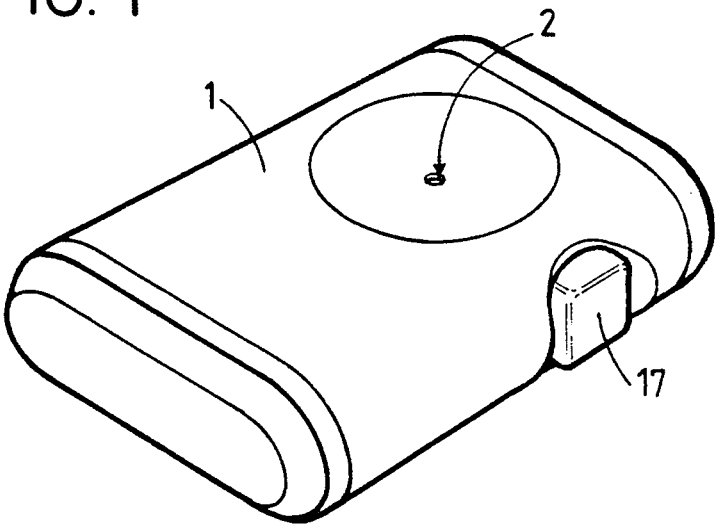
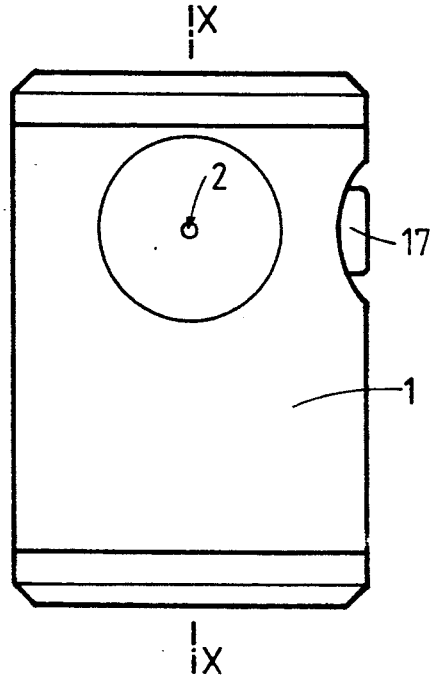
FIG. 1a
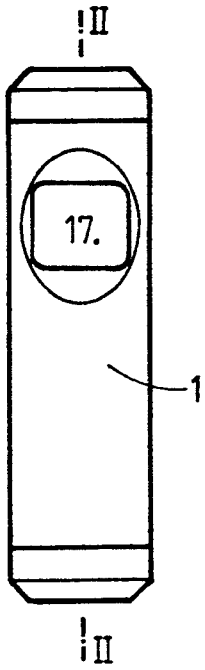
FIG. 1b

DEVICE FOR THE CONDITIONING AND THE DISTRIBUTION OF PASTY OR LIQUID PRODUCTS

FIELD OF THE INVENTION

The present invention relates to a device for the conditioning and the distribution of pasty or liquid products in the form of gel or emulsion as for example cosmetic or pharmaceutical products. Generally to condition such products one uses tubes or pots. The drawbacks of the use of plastic tubes reside in the fact that once open, the elasticity of the plastic allows a recall of air inside the tube which, after each expulsion of the product doses, presents oxidation problems or contamination of the content. Aluminium tubes do not present this drawback but their tendency to distort makes them unaesthetic and not very handy to use after only a few uses.

Cream pots, broadly used present the drawback of an important contact surface between the content and the environment, which induces important oxidation or contamination risks.

SUMMARY OF THE INVENTION

The aim of the present invention is to provide a device for the conditioning and the distribution of pasty or liquid products which remedy these drawbacks and which is characterized by the fact that it comprises a rigid casing having at least one chamber containing the product to distribute; by the fact that the casing still comprises at least one expulsion hole for the product; and by the fact that it comprises a control member reachable from the outside of the casing provoking during its operation the working of an expulsion mechanism of the product through the expulsion hole.

BRIEF DESCRIPTION OF THE DRAWINGS

The annexed drawing shows schematically and by way of example a device or distributing packing for pasty or liquid products according to the invention.

FIG. 1 is a perspective view of a device according to a first embodiment of the invention.

FIG. 1*a* is a front view of it.

FIG. 1*b* is a side view of it.

DETAILED DESCRIPTION OF THE INVENTION

Figure 3:
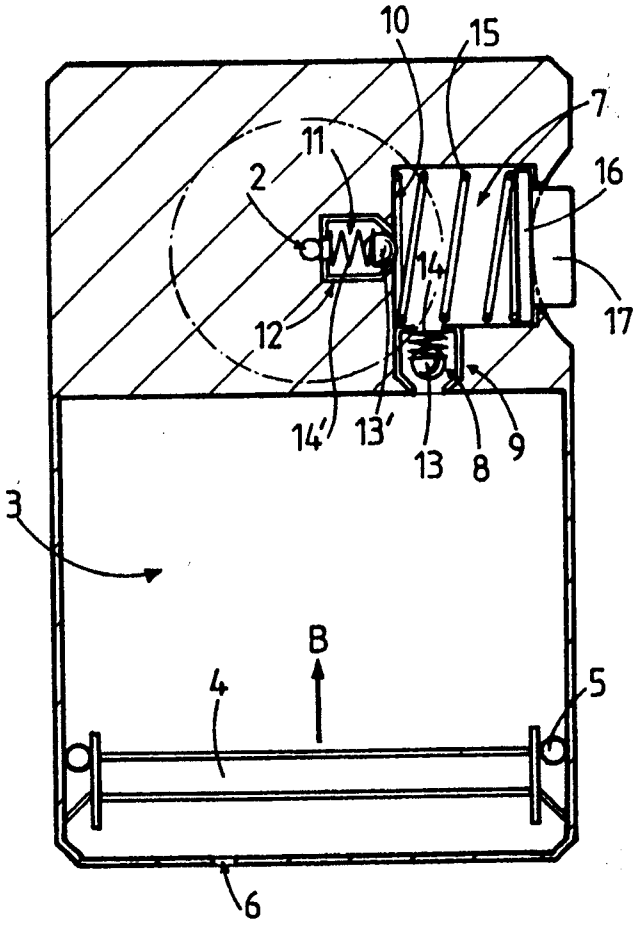
FIG. 3 is a similar cross sectional view of the first variant, the push button being in a rest position.
Figure 2:
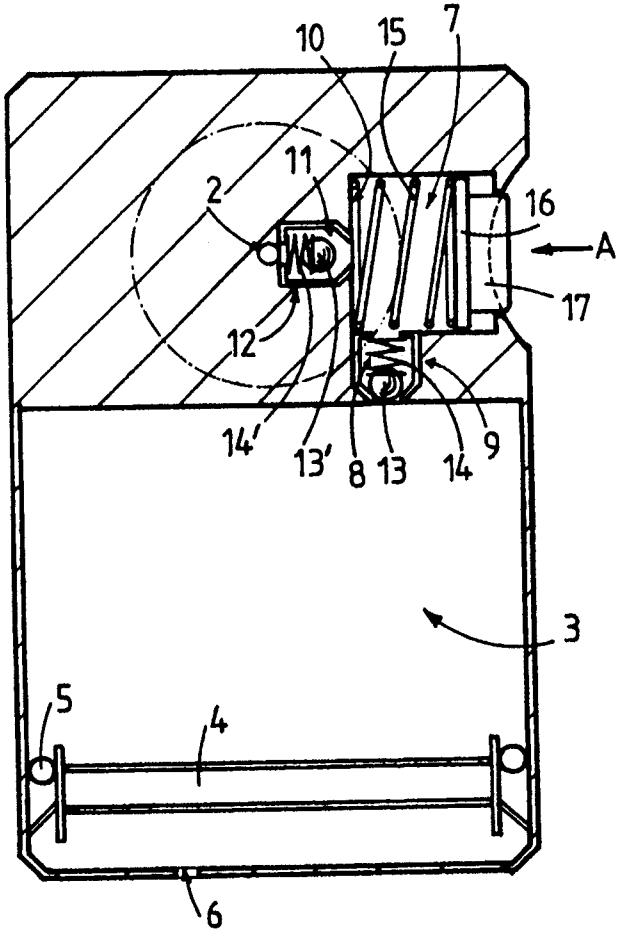
FIG. 2 is a cross sectional view along line II—II of FIG. 1*b* of a first variant, the push button being in a pushed position.

The distributing and conditioning device or packing according to the invention as shown at FIG. 1 comprises a rigid casing having a rectangular shape, this casing is bored with a channel ended by an expulsion hole 2 on one of its sides. This hole is located on the median axis X—X at about a third of the length of the casing and centered in a hollow located on the side thereof. FIG. 2 shows the casing I which comprises in its lower part a primary chamber 3. This primary chamber 3 is separated in two parts by a primary piston 4 freely sliding in this casing 1. A portion of this primary chamber is intended to contain the product to be conditioned and the other portion is connected to the free air by a bore 6 located at the bottom of the casing. This primary piston 4 has a joint 5 to insure tightness between the portion of the primary chamber 3 in which the product to be conditioned is housed and the casing 1. In a variant, a spring (not shown) is located between the bottom of the casing and the primary piston 4, this spring allows to compress the product.

The casing comprises in its upper part a secondary chamber 7 which communicates with the primary chamber 3 by an aspiration channel 8 having a non-return valve 9. The secondary chamber 7 comprises a shoulder 10 and communicates through an expulsion channel 11, also having a non-return valve 12, with the expulsion hole 2. Each non-return valve 9 or 12 is for example made up of a cylindrical hollow body having holes at each of its extremities. The upper part of this body has the shape of a truncated cone, while the other extremity of this body presents an edge. A ball 13, 13' which diameter is bigger than the diameter of the upstream hole is set in this body. A spring 14, 14' tends to apply the ball 13, 13' against the inner face of the truncated part of the body. The non-return valves 9, 12 are set in such a way to allow the passage of the product between the primary chamber 3 and the secondary chamber 7 and from this one toward the expulsion channel 2.

A spring 15 is located in the secondary chamber 7 and rests here against the shoulder 10 of this chamber and thereagainst a control member made of a piston 16 jointed to a push button 17 reachable from outside of the casing 1. When one acts on the push button 17 in the direction shown by the arrow A, the piston 16 sliding freely in the secondary chamber, compresses the dose of the product contained in this secondary chamber 7, this displaces the ball 13' against the action of its spring 14, 14' and allows the expulsion of an amount of product through the explusion hole 2. The non-return valve 9 prevents during this operation the product contained in the secondary chamber 7 to flow back in the primary chamber 3. When the push button 17 come back to its initial position under the action of the spring 15, a depression is created in the secondary chamber 7 which closes the non-return valve 12 and provokes an intake of the product from the primary chamber toward the secondary chamber through the non-return valve 9. The primary piston displaces itself in the direction of the arrow B under the action of the atmospheric pressure and eventually of an added spring (not shown) adjusting the volume of the portion of the primary chamber containing the product to the remaining volume thereof.

One should note that only the very small amount of product remaining in the non-return valve 12 is in contact with the outside air and thus submitted to an eventual oxidation or contamination.

Figure 5:
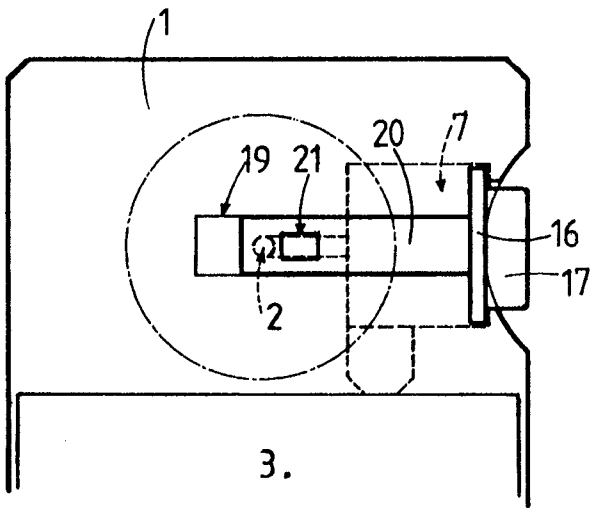
FIG. 5 is a similar section view of the second variant, the push button being in a relaxed position.
Figure 4:
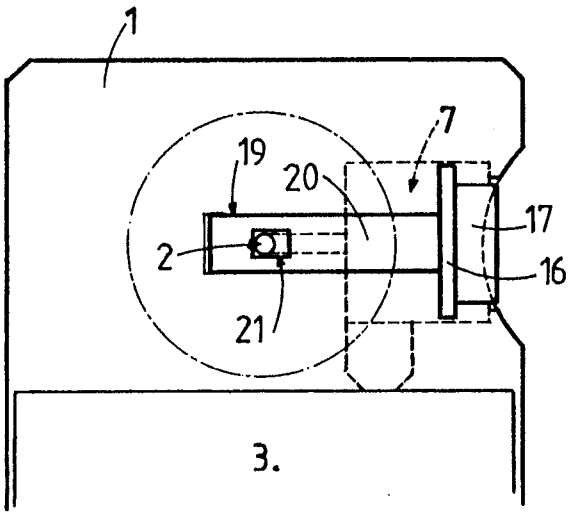
FIG. 4 is a partial section along line II—II of FIG. 1*b* of a second variant, the push button being in a pushed position.

In the second variant shown at FIGS. 4 and 5 the secondary chamber 7 is directly connected to the expulsion channel 2 without any non-return valve. A slot 19 located parallel to the axis of the piston 16 is made in the casing 1. The piston 16 is fastened to a small tab 20 bored with a slot 21. When the push button 17 is in a depressed position as illustrated at FIG. 4, the slot 21 of the tab 20 coincides with the expulsion channel 2 allowing the expulsion of the dose of the product contained in the secondary chamber 7. When the push button 17 come back to its resting position under the action of the spring 15, the tab 20 closes the expulsion channel 2. In this embodiment, the expulsion hole being closed in the inactive position of the packing, there are no contacts between the product and the outside air, insuring this way a total protection of the product against oxidation or contamination.

Figure 6:
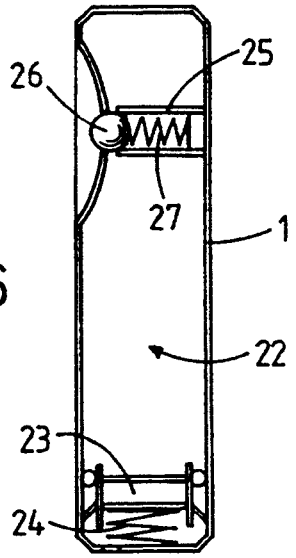
FIG. 6 is a cross sectional view along line X—X of FIG. 1*a* of a third variant, the expulsion hole being closed.
Figure 7:
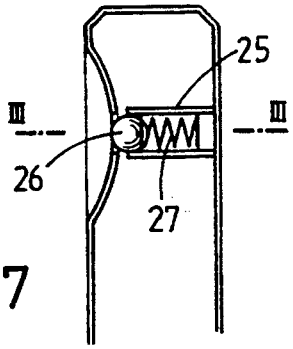
FIG. 7 is a partial cross section of the third variant, the expulsion hole being opened.

FIG. 6 shows a third variant of the packing and comprises a unique chamber 22 separated in two parts by a free piston 23. One of the part is filled with the product to be distributed whereas the other is in contact with air by a hole located in the bottom of the casing. A spring 24 abutting here against the bottom of the casing and against the free piston 23 allows product to be placed under pressure. The casing comprises a tube 25 or small guiding column located in the axis of the expulsion hole, fastened to the back wall of the casing, the other extremity of this tube being located at a distance of the expulsion hole determinated by the size of the closing member described hereunder. A ball 26 having a diameter substantially bigger than the diameter of the expulsion hole is located in this tube 25. A spring 27 in the tube 25 tends to apply the ball 26 against the expulsion hole. When one exerts a pressure with the finger on the part of the ball 26 which comes out of the expulsion hole, the product being under pressure comes out through the expulsion hole until one releases the pressure on the ball 26 which then closes again the expulsion hole under the action of the spring 27.

Figure 8:
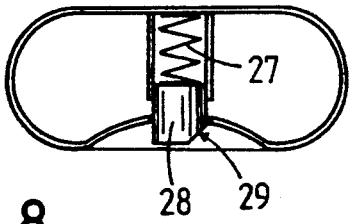
FIG. 8 is a cross sectional view along line III—III of FIG. 7 showing a variant of the obturation member in the third variant of the device.
Figure 9:
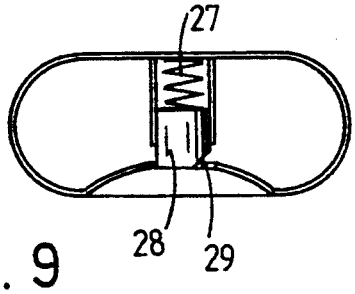
FIG. 9 is a cross sectional view of the variant shown at FIG. 8, the obturation member being in an open position.

The user may in this way determine the desired amount of product to be distributed. The ball 27 may be replaced by a cylindrical body 28 as shown at FIGS. 8 and 9. The head of this body 28 comprises a chamfered cutting 29. The cutting 29 emerges from the casing under the action of the spring 27. When one applies a pressure on this body (FIG. 9), the head of the body 28 penetrates in the casing, the cutting 29, allowing the expulsion of the product. This solution has the advantage that the output of the product is done only through the cutting 29, it means along a privileged direction, making that way the use of the packing more handy.

Figure 10:
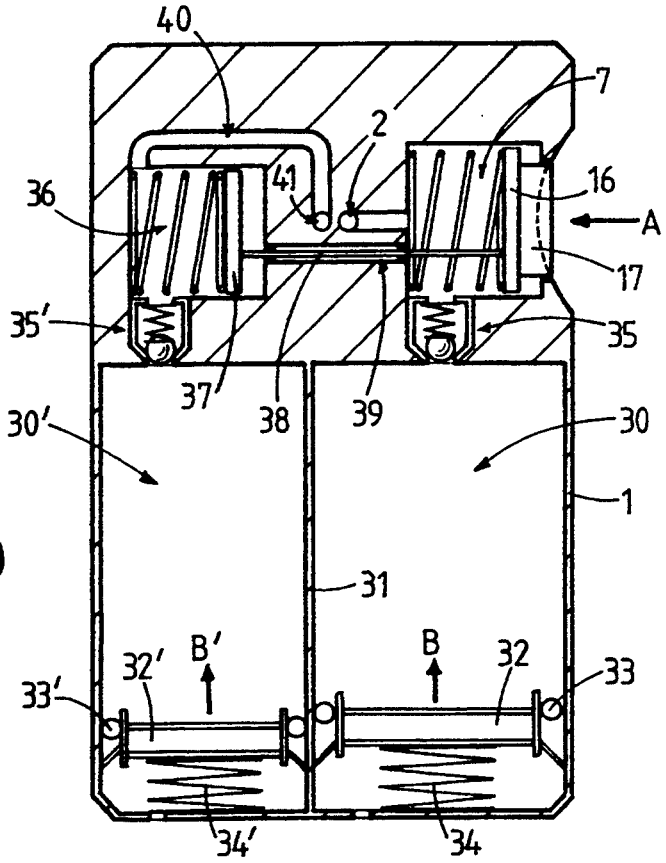
FIG. 10 is a cross sectional view along line II—II of FIG. 1*b* of the fourth variant of the first embodiment of the device.

FIG. 10 shows a fourth variant of the packing according to the first embodiment of the invention in which two different products are present in the casing and mix themselves at the time of the expulsion. In this embodiment, the casing 1 comprises a primary chamber longitudinally divided in two half chambers 30, 30' by a tight wall 31, each of these half chambers 30, 30' comprises a free primary piston 32, 32' having a tightness joint 33, 33'. A spring 34, 34' is introduced between the bottom of the casing and the primary piston 32, 32' of each of both half chambers 30, 30' so that the products contained in each of the upper part of said half chambers 30, 30' are under pressure. The right half chamber 30 communicates by an aspiration channel, in which is located a non-return valve 35, with the secondary chamber 7 containing the control piston 16 fastened to the push button 17 as in the first embodiment described before. The left half chamber 30' communicates by an aspiration channel having a non-return valve 35' with a second secondary chamber 36. This secondary chamber 36 comprises a piston 37. This piston 37 is fastened to the control piston 16 freely sliding in the secondary chamber 7 by means of an axle 38 sliding tightly in a channel 39 located in the casing 1 between the secondary chambers 7 and 36. An expulsion channel 40 bounds the second secondary chamber 36 to a second expulsion hole 41 located in the vicinity of the first expulsion hole 2 in the hollow of the casing 1. When one acts on the push button 17 in the direction of the arrow A, the piston 16 driving the piston 37, compresses the doses of the products contained in the secondary chambers 7, 36, and the doses of products are expelled respectively by the holes 2, 41. The non-return valves 35, 35' prevent the product to reflux toward the primary half chambers 30, 30'. When the pistons 16, 37 come back on the service position under the action of the springs, a depression is created in the secondary chambers 7, 36 which provokes an intake of the product from half chambers 30, 30' to the secondary chambers 7, 36 through the non-return valves 35, 35'. The primary pistons 32, 32' displace themselves in the direction of the arrows B, B' under the action of springs 34, 34'. This embodiment of the packing allows to expel a dose composed of two different products which mix only at the time use. In this embodiment, the piston 16 may cooperate with a closing member of the two explusion holes 2, 41 as the one described in the second embodiment at FIGS. 4 and 5.

By varying the diameter of the secondary chambers 7, 36 one with respect to the other, one modifies the proportion of the simultaneously expelled products.

The packing or conditioning and distributing device according to the invention may be used only once or may be refillable. In the latter case, the bottom of the casing is movable and one may introduce a refill under the form of a cartridge having for example a rigid bottom the shape of which corresponds to the shape of the casing and a soft sac containing the product. The bottom of the refill acts as a primary piston.

In a general manner, the primary chamber is divided in two parts by a separating member, one of these parts being linked to the secondary chamber and the other to the free air. The separating member may be a free piston as described above, or a membrane, or a soft or rigid part of a product refill.

The packing described has the following advantages. The product is never in contact with the outside air thereby preventing any oxidation. The contact with fingers when one uses the product is restricted to the dose that one will use thereby preventing any contamination lose the rest of the product. The packing does not lose its shape and has aesthetic qualities significantly improved over distorted tubes. The use of the packing is extremely simple and may be used with only one hand which is not the case with tubes. The product may be entirely used which is not easy when one deals with plastic tubes. The external shape and materials used for the making of the packing are adaptable to storage and transport requirements and also compatibilities issues with the product. Lastly, it is possible to distribute simultaneously doses of different products, in a determined proportion by acting on only one push button.

One should further note that with this packing one could save a secondary packing. As a matter of fact, the packing according to the invention may be distributed and sold without any supplementary conditioning, packing or box which is advantageous.

Figure 11:
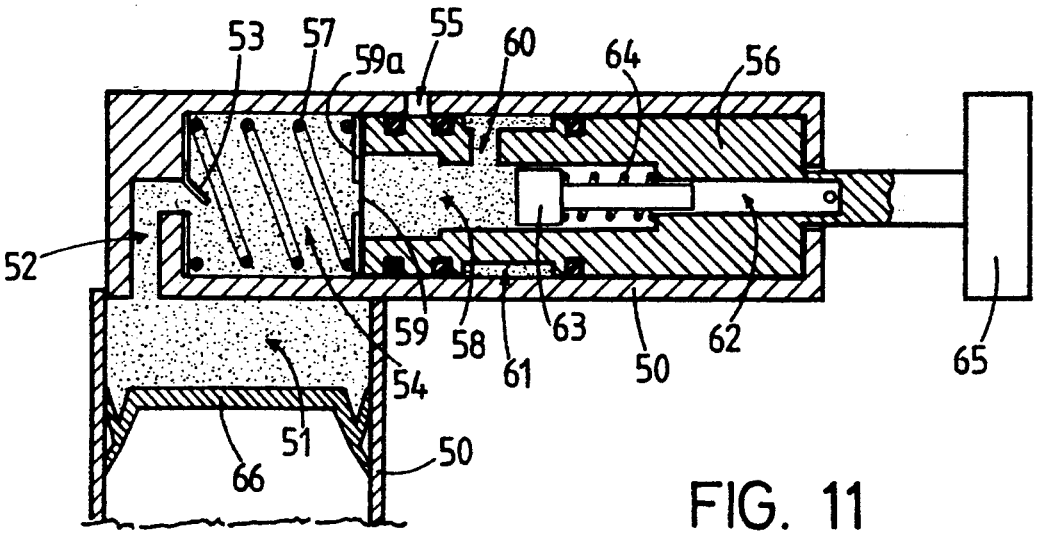
FIG. 11 is a partial cross sectional view of a second embodiment of the device according to the invention.

The second embodiment of the conditioning and distributing device of a liquid or pasty product shown partially in cross section at FIG. 11 comprises a rigid casing 50 presenting a chamber 51 intended to be filled with the product to be distributed, connected through a channel 52 and a first non-return valve 53 to the bottom of a bore 54 receiving the product distribution mechanism.

This product distribution mechanism is constituted by an output hole 55 coming out in the bore 54 of a primary piston 56 sliding in the bore 54 against the action of the return spring 57.

The primary piston 56 comprises a chamber 58 coming out on its frontal face and closed by a second non-return valve 59. This second non-return valve 59 is held fast in sandwich between the frontal face of the primary piston 56 and a ring 59*a* the hole of which has a dimension corresponding to the passage through of the valve 59. The ring 59*a* and the valve 59 are applied against the face of the piston 56 thanks to the spring 57. This chamber 58 is connected through a channel 60 to an annular chamber 61 coming out on the periphery of the main piston. Joints are provided between the main piston 56 and the casing 50 in the vicinity of the frontal extremity of the piston and on each side of the annular chamber 61. These joints may form a moulded part with the piston 56.

The main piston 56 further comprises a central dead bore 62, presenting a shoulder, coming out in the chamber 58. A decompression piston 63 slides freely in this central bore under the action of a return spring 64.

In this embodiment the main piston is rigidly fastened with a push button 65 for its moving. It is obvious that any member or acting device, pawl, toothed rack, etc. may be provided to displace the main piston against the action of the spring 57 in the bore 54.

The chamber 51 which contains the product to be conditioned and distributed is closed near the bottom of the casing 50 by a movable bottom 66 having tightness lips rubbing against the casing 50 and freely sliding in said chamber 51.

The operation of the described distributing device is the following:

At rest position, the device is in the position shown at FIG. 11. The channel 52, the chamber 58, the channel and the annular chamber 61 are filled with the product to be distributed. The output hole 55 is closed by the main piston 56.

Figure 12:
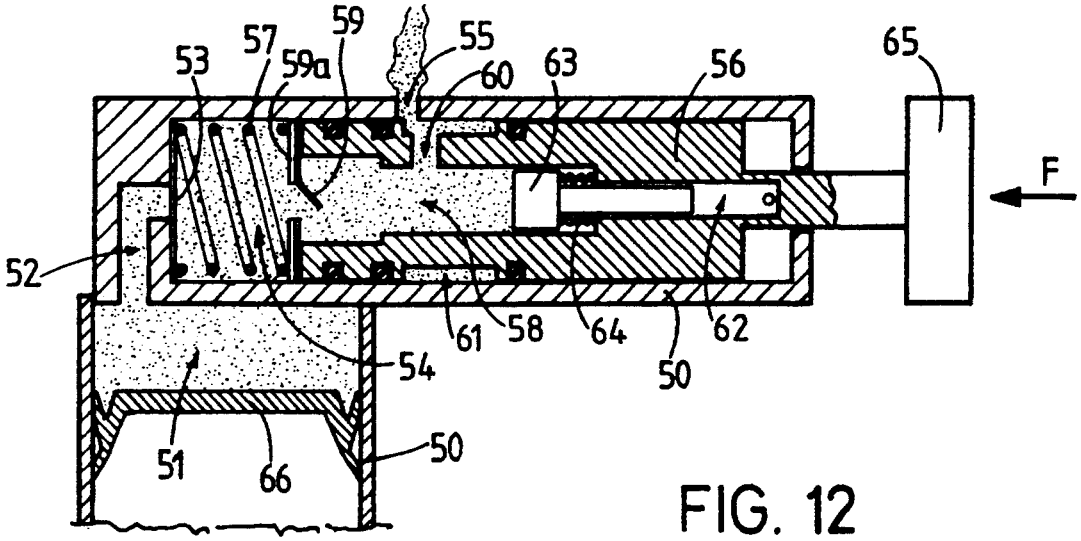
FIGS. 12 and 13 are cross sections similar to those shown at FIG. 11, the main piston of the device being in other working positions.
Figure 13:
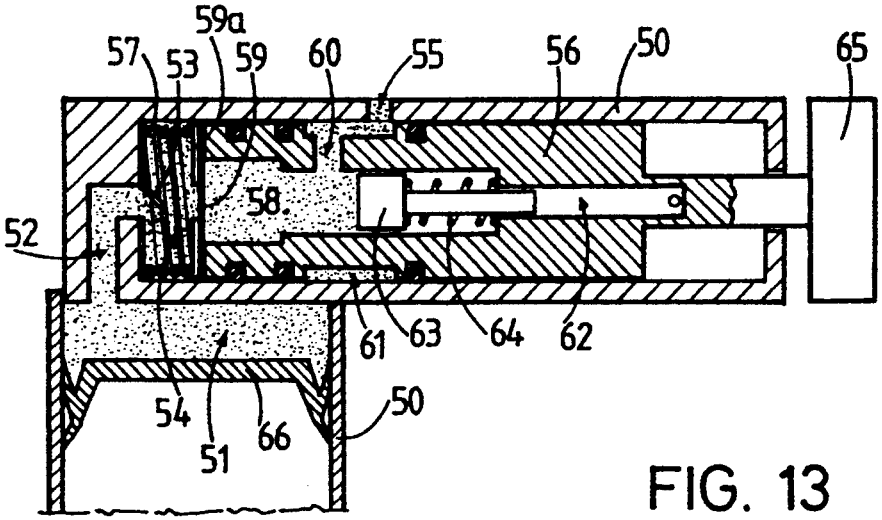

From this position, the user acts on the push button following the direction shown by the arrow F, displacing the main piston 56 inside the bore 54 against the action of the spring 57 which provokes:

in a first step (FIG. 12), the closing of the non-return valve 53 and the opening of the non-return valve 59 allowing the introduction of the product contained in the bottom of the bore 54 into the chamber 58 of the main piston 56 inducing the displacement of the decompression piston 63 against the action of its return spring 54. Thus, even if the output hole 55 is closed, the product to be distributed is not put under pressure by the displacement of the main piston 56;

in a second step (FIG. 13), as soon as the annular chamber 60 of the main piston 56 communicates with the output hole, any subsequent displacement of the main piston 56 provokes the expulsion of an amount of product, amount the volume of which is defined by the stroke and the diameter of this main piston. The end of the distribution of the product occurs either when the main piston reaches the end of the stroke, or when the annular chamber 61 of this piston is no longer communicating with the output hole. Meanwile, the secondary piston comes back to a rest position under the action of its return spring.

When the user releases the push button 65, the main piston 56 goes back to the rest position (FIG. 11) under the action of the spring 57. Doing this, the non-return valve 59 closes, preventing this way any intake of air through the output hole 55 when the non-return valve 53 opens and that the product in the chamber 51 is sucked thanks to the vacuum through the channel 52 into the extremity of the bore 54. At the end of the return stroke of the main piston 56, the output hole 55 is again closed. The movable bottom 66 goes up in the chamber 51 under the action of the created vacuum, avoiding this way any contact of the product with the air.

Furthermore, this very simple mechanism requires few as the pieces and is easy to manufacture, pieces can be easily machined, molded or injected.

Figure 14:
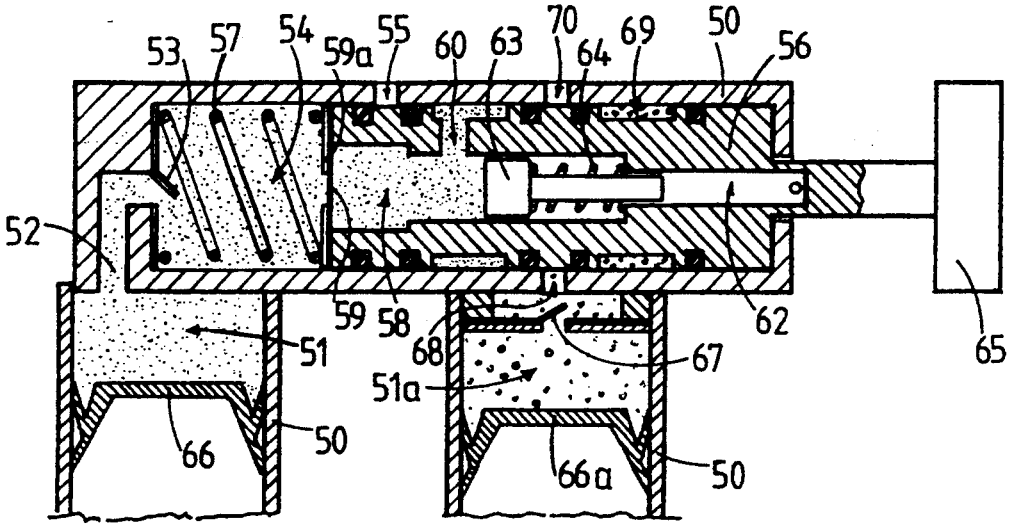
FIG. 14 is a partial cross section of a third embodiment of the device according to the invention.

In the third embodiment of the device shown at FIG. 14, the casing 50 comprises two chambers 51, 51*a* intended to receive two different products, one pasty and the other liquid for example. The distributing and dosing mechanism of the product contained in chamber 51 is identical to the one described in reference to FIGS. 11 to 13. The distribution and dosing mechanism of this product contained in the chamber 51*a* may comprise a non-return valve 67 located in the upper part of the chamber 51*a* which comprises a hole 68 coming out in the bore 54. In a variant, this non-return valve 67 may be withdrawn. The main piston 56 comprises a second annular chamber 69, also delimited by joints, and the casing comprises a second output hole 70. Lastly, both chambers 51, 51*a* comprise a movable bottom 66, 66*a*.

When the user acts on the push button 65, the distribution of the product contained in the chamber 51 is carried out as previously described. During the forward stroke of the main piston 56, the non-return valve 67 remains closed. On the other hand, during the return stroke of the main piston 56, when the annular chamber 69 communicates with the hole 68, the product contained in the chamber 51*a*, pushed up by the bottom 66*a* rigidly bound to the bottom 66 of the chamber 51, opens the non-return valve 67, comes into the annular chamber 69, and is expelled through the output hole 70. As soon as the annular chamber 69 is no longer connected to the output hole 70 and the hole 68, the expulsion of the second product stops. In that manner, to expel the product contained in the chamber 51*a*, one uses the displacement of the bottom 66 of the chamber 51, occuring by vacuum to provoke a corresponding displacement of the bottom 66*a* of the chamber 51*a*. In this manner one insures that both chambers 51 and 51*a* are simultaneously empty.

Figure 15:
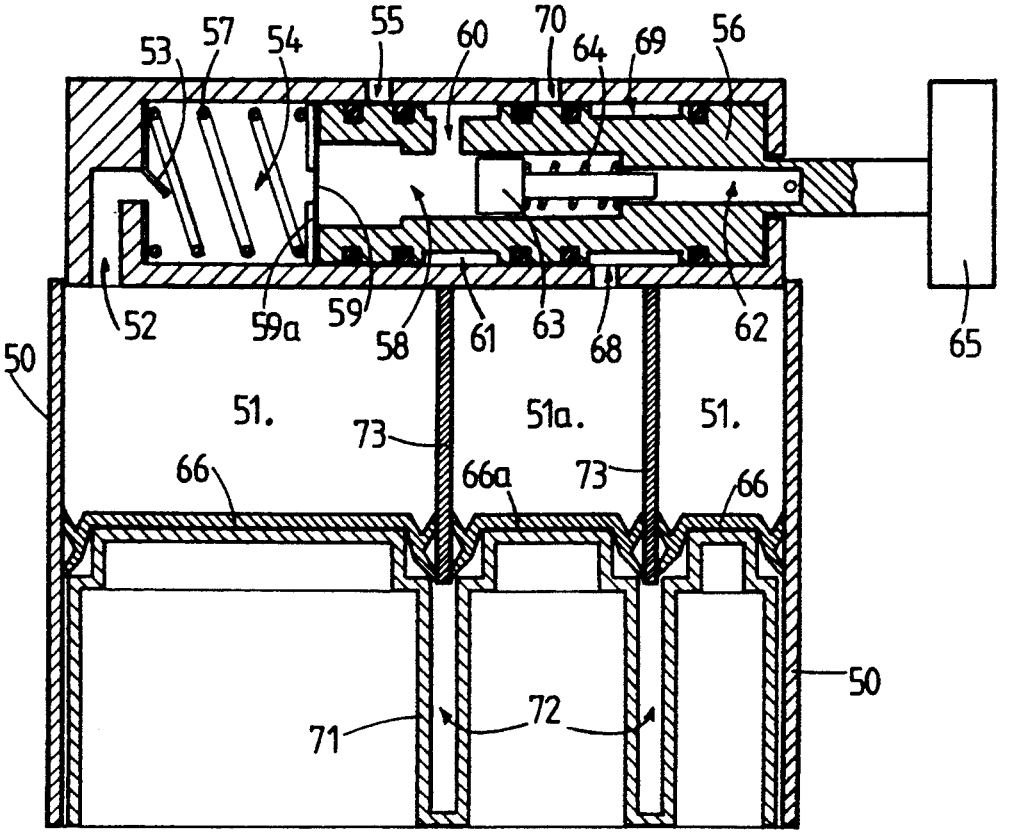
FIG. 15 is a partial cross section of a fourth embodiment of the device according to the invention.

In the fourth embodiment shown at FIG. 15, the device is similar to the one described with reference to FIG. 14, but the second chamber 51*a* is completely surrounded by the chamber 51 which presents a hollow cylindrical shape. The movable bottom 66 of the chamber 51 has also an annular shape. A skirt-piston 71 or bottom of the casing 50 is provided which freely slides inside external walls of the casing 50 and which is rigidly locked with movable bottoms 66 and 66*a*. This skirt-piston 71 comprises an annular groove 72 intended to allow the passage of the annular wall 73 of the second chamber 51*a* during its upward displacements. In this manner, the displacement of the movable bottom 66*a* is induced by the displacement of the skirt-piston 71 dragged along with the displacements of the movable bottom 66.

In this last embodiment, the non-return valve 67 is withdrawn, the tightness of the second chamber 51*a* being provided by the slack of the main piston and the holes 68 and 70.

In the three last described embodiments, the non-return valves are constituted by disks or rings in moulded plastic material presenting a central small tab connected by a portion of its periphery to the disk. The disk presents a hole having dimension slightly smaller than those of the small tab movable by flexion. The small tab may be displaced with regards to the disk in order either to close the hole thereof, or on the contrary to free an outlet through the disk. To facilitate the resilient distorsion of the small tab preferably in one direction, the disk presents a weakening on one of its face at the place where the small tab is connected to it.

This non-return valve is very simple, cheap, easy to manufacture and has turned out to be very reliable.

The non-return valve 53 presents a disk having an external diameter corresponding to the internal diameter of the dead bore 54 and is maintained against the bottom thereof thanks to the support of the spring 57.

The non-return valve 59 presents an external diameter corresponding to the external diameter of the main piston 56 and is applied against the frontal extremity thereof thanks to a small round disk submitted to the action of the spring 57.

Finally, the non-return valve 67 is maintained between a perforated wall in the upper part of the second chamber 51*a* and an annular embossing or collar located between this upper perforated wall and the wall of the dead bore of the casing.

In variants of the device, chambers 51 and/or 51*a* may contain or be replaced by pouches filled with the product to be distributed. These pouches may be connected in a movable manner to the product output holes in the bore 54 so that they can be thrown away once they are empty and replaced by full pouches.

These three last embodiments of the device according to the invention solve the same problems and present the same advantages as those enumerated with reference to the first embodiment.

We claim:

1. In a device for dispensing pasty or liquid products, comprising a rigid casing (50) containing a first chamber (51) adapted to be filled with a product to be dispensed, a second chamber (54) within the casing to receive from the first chamber the product to be dispensed, a first non-return valve (53) between the first and second chambers adapted to pass the product to be dispensed only in a direction from the first chamber to the second chamber, a third chamber (58) within the casing, a second non-return valve (59) disposed between the second and third chambers and adapted to permit passage of the product to be dispensed only in a direction from the second chamber to the third chamber, an output hole (55) in the casing adapted to receive said product from said third chamber and to provide an exit from the device for the dispensed material, a piston (56) reciprocably slidable in the casing in opposite directions to increase and decrease the volume of the second chamber (54), thereby to urge said material from said second chamber (54) through said second non-return valve (59) into said third chamber (58) when said piston moves in a first direction to decrease the size of said second chamber (54), means (65) for manually urging said piston in said first direction, and a return spring (57) urging said piston (56) in a second direction opposite said first direction, said second non-return valve (59) being carried by said piston (56) and said third chamber (58) being within said piston (56); the improvement comprising a secondary piston (63) slidably mounted within the first-mentioned piston (56) for movement relative to said first-mentioned piston (56) in said first and second directions, and spring means (64) acting between said secondary piston (63) and said first-mentioned piston (56) continuously to urge said secondary piston 63) in said first direction, said secondary piston (63) having a surface exposed to the interior of said third chamber (58).

2. A device according to claim 1, wherein said first-mentioned piston (56) closes said output hole during an initial portion of movement of said first-mentioned piston (56) in said first direction and opens said output hole (55) only during a final portion of movement of said first-mentioned piston (56) in said first direction.

3. A device according to claim 1, further comprising a fourth chamber (51*a*) containing a second product and having a movable bottom (66*a*) rigidly connected to a movable bottom (66) of the first chamber (51), a second output hole (70) in the casing adapted to receive said second product from said fourth chamber, said piston (56) opening the first-mentioned hole (55) and closing the second hole (70) in one position of the piston (56) and closing said first-mentioned hole (55) and opening said second hold (70) in another position of said piston (56).

4. A device according to claim 3, wherein said first chamber (51) surrounds said fourth chamber (51*a*).

5. In a device for dispensing pasty or liquid products, comprising a rigid casing (50) containing a first chamber (51) adapted to be filled with a product to be dispensed, a second chamber (54) within the casing to receive from the first chamber the product to be dispensed, a first non-return valve (53) between the first and second chambers adapted to pass the product to be dispsensed only in a direction from the first chamber to the second chamber, a third chamber (58) within the casing, a second non-return valve (59) disposed between the second and third chambers and adapted to permit passage of the product to be dispensed only in a direction from the second chamber to the third chamber, an output hole (55) in the casing adapted to receive said product from said third chamber and to provide an exit from the device for the dispensed material, a piston (56) reciprocably slidable in the casing in opposite directions to increase and decrease the volume of the second chamber (54), thereby to urge said material from said second chamber (54) through said second non-return valve (59) into said third chamber (58) when said piston moves in a first direction to decrease the size of said second chamber (54), means (65) for manually urging said piston in said first direction, and a return sprint (57) urging said piston (56) in a second direction opposite said first direction, said second non-return valve (59) being carried by said piston (56) and said third chamber (58) being within said piston (56); the improvement wherein said piston (56) closes said output hole during an initial portion of movement of said piston (56) in said first direction and opens said output hole (55) only during a final portion of movement of said piston (56) in said first direction.

6. A device according to claim 5, further comprising a fourth chamber (51*a*) containing a second product and having a movable bottom (66*a*) rigidly connected to a movable bottom (66) of the first chamber (51), a second output hole (70) in the casing adapted to receive said second product from said fourth chamber, said piston (56) opening the first-mentioned hole (55) and closing the second hole (70) in one position of the piston (56) and closing said first-mentioned hole (55) and opening said second hole (70) in another position of said piston (56).

7. A device according to claim 6, wherein said first chamber (51) surrounds said fourth chamber (51*a*).

* * * * *